United States Patent [19]

Ohtsuka et al.

[11] 4,436,802

[45] Mar. 13, 1984

[54] REVERSAL ELECTROPHOTOGRAPHY DEVELOPING METHOD

[75] Inventors: Shuichi Ohtsuka; Yasuo Aotsuka, both of Kaisei, Japan

[73] Assignee: Fuji Photo Film Co., Ltd., Tokyo, Japan

[21] Appl. No.: 446,273

[22] Filed: Dec. 2, 1982

[30] Foreign Application Priority Data

Dec. 7, 1981 [JP] Japan ..... 56-196627

[51] Int. Cl.[3] ..... G03G 13/09

[52] U.S. Cl. ..... 430/100; 430/106.6; 430/122; 430/903

[58] Field of Search ..... 430/100, 106.6, 122, 430/903

[56] References Cited

U.S. PATENT DOCUMENTS 4,277,552 7/1981 Asanae et al. ..... 430/122
4,286,036 8/1981 Hendriksma ..... 430/100
4,288,515 9/1981 Yamashita et al. ..... 430/100
4,376,813 3/1983 Yuge et al. ..... 430/100

FOREIGN PATENT DOCUMENTS 2810854 9/1978 Fed. Rep. of Germany ..... 430/100
55-38575 3/1980 Japan ..... 430/100

*Primary Examiner*—Roland E. Martin, Jr.
*Attorney, Agent, or Firm*—Gerald J. Ferguson, Jr.; Joseph J. Baker

[57] ABSTRACT

An electrophotography developing method according to this invention uses a one-component magnetic toner having an electric resistivity of $10^7$ or more ohm·centimeter, still remaining within the range of inter-particle electric induction, and a coercive force of 150 or more oersteds, thereby preventing appearance of fog in a reversal photographic image, which fog otherwise, would appear in case of reversal, magnetic brush development.

3 Claims, 3 Drawing Figures

REVERSAL ELECTROPHOTOGRAPHY DEVELOPING METHOD

BACKGROUND OF THE INVENTION

1. Field of the Invention

This invention relates to an improvement in an electrophotography using a magnetic brush developing method for performing reversal development with a one-component magnetic toner.

2. Description of the Prior Art

It is well known that a photographic positive of an image to be reproduced is obtained by means of magnetic brush development with a one-component toner (positive development). Specifically, first, an electrophotosensitive material is electrostatically charged; the so electrostatically charged sheet is exposed to an image to be reproduced, thereby forming a corresponding electrostatic latent image, and finally, toner particles are applied according to the magnetic brush developing method to the part of the photosensitive sheet on which electric charges still remain (i.e. unilluminated part of the photosensitive sheet). This kind of positive development is disclosed, for instance, in Japanese Patent Publication No. 56(1981)-2705.

Also, it is well known that a photographic negative is obtained according to the magnetic brush developing method using a one-component toner (reversal development). After forming an electrostatic latent image on an electrophotosensitive material in the same way as mentioned above toner particles are applied to the illuminated part or electric charge-free part of the material according to the magnetic brush developing method. While developing almost the same bias voltage as is applied to the photosensitive sheet is applied to a development sleeve of a developing device. This reversal development is disclosed in Japanese Patent Publication No. 56(1981)-2705 and Japanese Unexamined Patent Publication No. 52(1977)-146243, 53(1978)-112740, 53(1978)-115299 and 54(1979)-98248.

The experiments which the present inventors made, revealed that when a photographic reversal image was obtained by developing an electrophotosensitive material composed, for instance, of a dispersion of pulverized zinc oxide in an appropriate binder, a relatively extensive fog appeared in the reversal photographic image, and it had poor contrast, compared with a photographic positive image.

Japanese Unexamined Patent Publication No. 55(1980)-134864 discloses an improved magnetic brush developing method according to which a reversal photographic image having reduced fog and good contrast can be obtained. According to the disclosed method an electrophotosensitive material is electrostatically charged to a relatively low potential compared with the potential which would appear on the electrophotosensitive sheet when electrostatically charged to its full capacity (hereinafter referred to as "saturation-charging potential"). For instance, the material is electrostatically charged to a potential as low as 60 percent of the saturation-charging potential. When developing, a potential of the same polarity and same value as (or somewhat larger value than) the potential appearing on the so charged material, is applied to a one-component toner powder.

This method proposed and for which patent has been applied for assures production of reversal photographic images of the same quality as positive photographic images obtained by magnetic brush development using a one-component magnetic toner. The method, however, has some defects as follows; it requires a "scorotron", or a charged ion-generating apparatus having a main power supply for corona wires and a sub-power supply for grid electrodes, which is designed for controlling the amount of electric charges emitted from the corona wires. Thus, the apparatus which is used in carrying out the proposed method is very expensive and large in size.

In operation it is necessary to electrostatically charge electrophotosensitive material to a predetermined potential or higher. Disadvantageously, a "slorotron" requires an extended length of time for electrostatic charging, compared with a "corotron", and therefore the use of "scorotron" is a detriment to the speed-up of development. In an attempt to expedite development a combination of a "scorotron" with a "corotron" is proposed in Japanese Unexamined Patent Publication No. 55(1980)-144260. With recourse to the proposed combination, however, the time involved for development cannot be shortened enough. Another disadvantage is that the proposed apparatus inevitably becomes very complicated and larger in size compared with the use of a "corotron" above.

SUMMARY OF THE INVENTION

In view of the above the object of this invention is to provide an electrophotography developing method according to which an electrophotosensitive material at "saturation-charging potential" is developed with a one-component magnetic toner to produce a reversal photographic image of high quality, that is, without fog and having good contrast.

In electrophotography in which an electrophotosensitive material is electrostatically charged to its "saturation charging potential", is exposed to an image to be reproduced to form an electrostatic latent image, and finally, is subjected to a magnetic brush, reversal development with a one-component magnetic toner at a bias potential of the same polarity as the potential appearing on the electrostatically charged material, the improved developing method according to this invention uses a one-component magnetic toner having a resistivity of $10^7$ or more ohm. centimeter still remaining within range of electric charge induction of inter-toner particles and a coercive force of 150 or more oersteds.

This invention will be better understood from the following description of preferred embodiments, which description is made with reference to the accompanying drawings.

DESCRIPTION OF THE PREFERRED EMBODIMENTS

Figure 1:
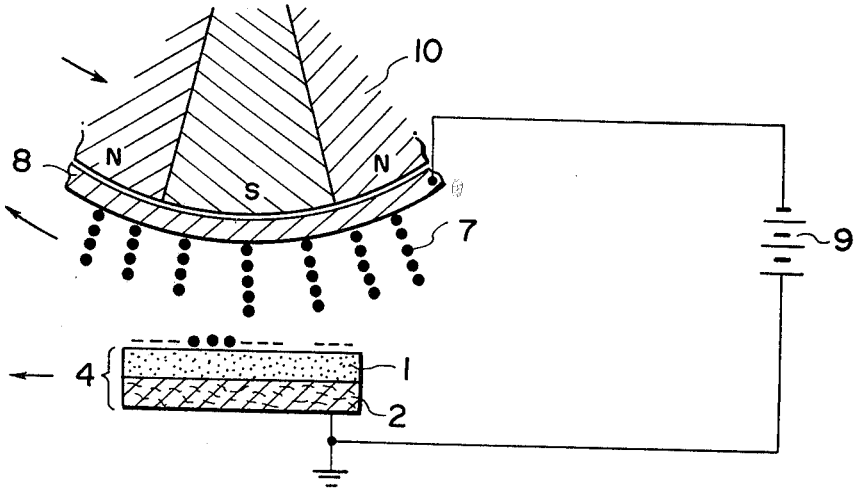
FIG. 1 shows schematically a cross-section of a reversal development apparatus which is designed for magnetic brush development.

Referring to FIG. 1 there is shown a reversal development device which is designed appropriately for magnetic brush development.

An electrophotosensitive sheet 4 is composed of an electrically-conductive treated paper 2 and an overlying a photosensitive layer 1. The photosensitive layer 1 is composed of an inorganic photoconductive substance such as zinc oxide or cadmium sulfide pulverized and dispersed in a resin. The electrophotosensitve sheet 4 is electrostatically charged to its "saturation charging potential" with the aid of a corona charging device, and then the so charged sheet is exposed to an image to be reproduced to form an electrostatic latent image.

The illuminated part of the photosensitive layer 1 loses electric charges whereas the unilluminated part of the photosensitve layer retains electric charges. The electrically conductive support 2 is grounded. The positive terminal of a d.c power supply 9 is grounded, and the negative terminal of the power supply 9 is connected to a stationary development sleeve 8 to apply a negative bias voltage to the development sleeve 8 of a developing device. The development sleeve 8 is made of an electrically conductive material. A rotary multipoled magnet 10 is provided inside of the stationary development sleeve 8.

The sheet of electrophotosensitive material which is appropriate for use in this invention is composed of a pulverized photoconductive substance dispersed in a binder or sintered in the form of a layer, and is disposed to overlie an electrically conductive support. As specific examples of photoconductive material zinc oxide, titanium oxide, lead oxide and other metal oxides; cadmium sulfide and other metal sulfides; and phthalocyanine and other organic dyes. These materials may be used alone or in combination, or together with sensitivity-intensifying dye or other additives. A metal foil and a sheet of electrically-conductive treated paper or plastics may be used as an electrically conductive support.

An electrophotosensitive sheet is electrostatically charged to its "saturation charging potential" with a conventional charging device. Then, the amount of electric charge put on the surface of the electrophotosensitive sheet is increased by reducing the distance between the sheet and the charging device; extending the length of charging time; charging repeatedly or applying an increased voltage to the charging device. The charging is continued until the potential on the surface of the sheet has reached as high as 90 percent or more of the maximum potential which would appear on the surface of the sheet if electrostatically charged to its full capacity.

The results of the experiments which were made with a development device as partly shown in FIG. 1 and described above, are explained below in terms of the electric resistivity and the coercive force of various one-component toners.

The electric resistivity of one-component toner is related with the concentration of a photographic image which is obtained by reversal, magnetic brush development.

TABLE 1

| Resistivity of toner ($\Omega \cdot$ cm) | Image reflection concentration for bias voltage (−300 volts) | Image reflection concentration for bias voltage (−800 volts) |
|---|---|---|
| $2.5 \times 10^6$ | 0.1 | 0.15 |
| $5.0 \times 10^7$ | 0.3 | 0.6 |
| $3.3 \times 10^9$ | 0.45 | 1.0 |
| $1.7 \times 10^{11}$ | 0.8 | 1.4 |

The development device used had an 8-pole magnetic roll which was 24.5 centimeters in diameter and was capable of establishing a magnetic field of 700 gauss. The magnetic roll was rotated at the speed of 1000 revolutions per minute within a stationary sleeve. An electrophotosensitive sheet of zinc oxide was electrostatically charged, and was exposed to an image to be reproduced to form a corresponding latent image. The sheet was moved at the speed of 7.5 centimeters per second under the developing device.

As is apparent from Table 1, a photographic image of good contrast could not be obtained without using a toner of resistivity of more than $10^7$ Ω.cm. The electrostatic force surpassing the magnetic attractive force attracts toner particles 7 away from the development sleeve 8 onto the electrophotosensitive layer 1. If the toner 7 has a relatively low resistivity, the toner is supposed to lose its electric charge easily, thus causing the attractive electric force to diminish quickly and eventually reducing the concentraction of a photographic image. The transfer of electric charges from the toner particles to the underlying electrophotosensitive sheet is supposed to depend on the degree of easiness with which electric charges are injected from the toner to the electrophotosensitive sheet. If use is made of an electrophotosensitive sheet of zinc oxide, minus electric charges are supposed to be easy to transfer from toner particles to the zinc oxide sheet because the electron conduction band of the metal oxide is at a relatively low energy level (See Photochem. Photobiol., 16, P.219–P.241, 1972), and therefore is a toner powder of relatively low resistivity is used, and if it is given minus electric charges, the toner powder when put on the sheet is supposed to lose its electric charges quickly, eventually lowering the contrast of a resultant photographic image. In case of positive development in which the toner powder is at a positive potential with respect to an electrophotosensitive sheet (for instance, the toner particles being maintained at zero potential, whereas the electrophotosensitive sheet is maintained at a negative potential) the toner powder causes no problem no matter what resistivity it may have.

Figure 2:
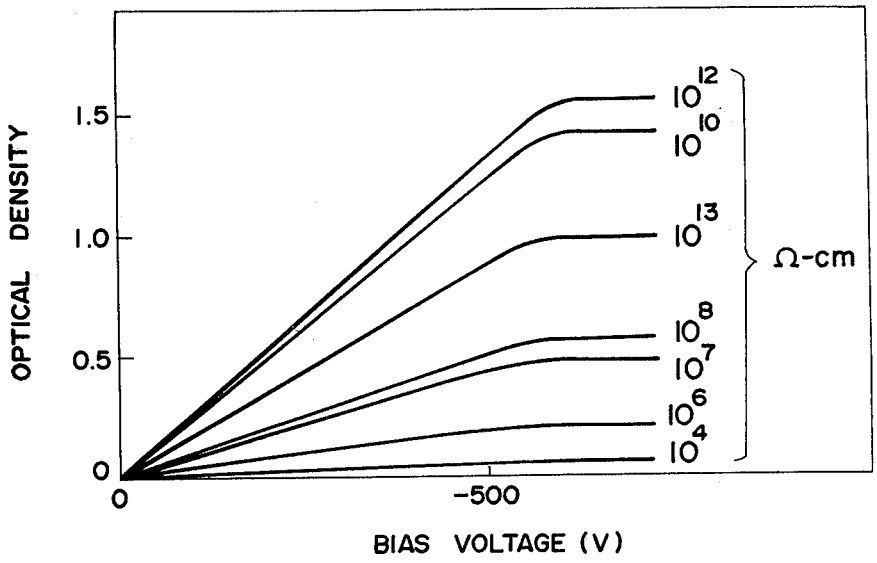
FIG. 2 is a graphic representation of experimental data showing the image concentration-to-bias voltage relationship for different electric restivities of various toners.

FIG. 2 is a graphic representation of the experimental data showing various image density-to-bias voltage relationships for various kinds of toner powder having different electric resistivities.

As is readily understood from the graph of FIG. 2, the imge density increases with the increase in electric resistivity of the toner powder.

The image density, however, decreases with the increase in electric resistivity of the toner powder above $10^{12}$ Ω.cm. The induction of electric charge from toner to toner particle is supposed to be hard to cause in toner powder of such high resistivity. Specifically, toner particles 7 are attracted by the multi-poled magnet 10, and are attached to the development sleeve 8 in the form of chain, as shown in FIG. 1. If a toner powder of electric resistivity of more than $10^{12}$ Ω.cm is used, the toner particles remotest from the development sleeve 8, in fact, cannot be brought to as high potential as the bias voltage of the development sleeve 8, and accordingly a reduced electric field exists in the space between the surface of the electrophotosensitive layer 1 and the toner particles remotest from the development sleeve, eventually reducing the density of the resultant photographic image. In the experiments mentioned above the electric resistivity of toner powder was determined in the manner as taught in U.S. Pat. No. 3,639,245.

The electric resistivity of toner material can be controlled by adjusting the amount of carbon to be added for making a toner material electrically conductive.

As is understood from Table 2, the coercive force "Hc" of toner material and the strength of magnetic field at the development sleeve are related with appearance of fog in a resultant photographic image.

TABLE 2

| Strength of magnetic field at a development sleeve (gauss) | Coercive force of a toner material (oersted) | Range of bias voltage effective to prevent appearance of fog (volt) |
|---|---|---|
| 700 | 300 | −700−−1200 |
| 700 | 230 | −900−−1200 |
| 700 | 150 | −950 |
| 550 | 300 | −900−−1000 |

Two development devices were used. One of these devices had an 8-pole rotary magnet roll. The roll was 24.5 mm in diameter, and was capable of establishing a magnetic field of 700 gauss on an associated development sleeve. The other development device also had an 8-pole rotary magnet roll. The roll was 24.5 mm in diameter, and was capable of establishing a magnetic field of 550 gauss. Electrophotosensitive sheets used were composed of zinc oxide pulverized and dispersed in a resin.

As shown in Table 2, "fogless" photographic images can be obtained for coercive force of 150 or more oersteds and for magnetic field of 700 gauss. The cause for appearance of fog in the resultant photographic image is unknown, but it seems that: a potential gradient appears between the toner particles 7 and the unilluminated part of the electrophotosensitive layer 1 (corresponding to the white part of a resultant photographic image), thereby electrostatically attracting toner particles to the unilluminated part of the electrophotosensitive layer, and causing the appearance of fog in a photographic image. If the coercive force of the toner material is above 150 oersteds, the magnetic attractive force becomes greater than the undesired electrostatic attractive force, and then extra toner powder is attracted back to the development sleeve 8 rather than to the unilluminated part of the electrophotosensitive layer 1, thus resulting in a photographic image without fog.

The coercive force of a toner material depends on the shape of the magnetite crystals, as for instance about 100 oersteds for the spherical crystal and about 300 oersteds for the needle-like crystal. The coercive force of a cobalt dope treated toner material ranges from about 800 to 1200 oersteds. A toner material of as high coercive force as desired can be obtained by mixing the various kinds of magnetic powder in an appropriate ratio. A conventional toner powder which meets the requirements as mentioned above can be used in development according to this invention. The saturation magnetization of the toner material is preferably not less than 55 emu/g.

Figure 3:
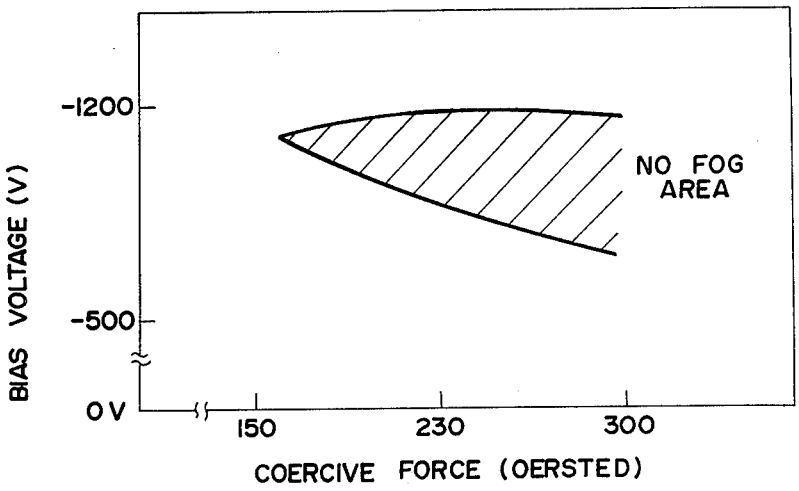
FIG. 3 is a graphic representation showing a fogfree area in the coercive force versus bias potential domain.

FIG. 3 is a graphic representation of experimental data showing a "fogless" area in a bias voltage-to-coercive force domain. As is readily understood from the graph, the coercive force of 230 or more oersteds allow more or less deviation of bias voltage apart from a most appropriate value, and then a "fogless" reversal photographic image is assured.

As is apparent from the above, this invention permits a one-component magnetic toner brush to develop a reversal photographic image of high quality, that is, without fog and having good contrast.

We claim:

1. In electrophotography in which an electrophotosensitive material is electrostatically charged to its "saturation charging potential"; is exposed to an image to be reproduced to form an electrostatic latent image; and finally is subjected to a magnetic brush, reversal development with a one-component magnetic toner at a bias potential of the same polarity as the potential appearing on the electrostatically charged material, an improved developing method characterized in that it uses a one-component magnetic toner having a resistivity of $10^7$ or more ohm.centimeter within the range of electric charge induction of inter-toner particles and a coercive force of 150 or more oersteds.

2. An electrophotography developing method according to claim 1 wherein said electrophotosensitive material includes a layer of pulverized photosensitive substance dispersed in a binder.

3. An electrophotography developing method according to claim 2 wherein said photosensitive substance is zinc oxide.

* * * * *